United States Patent [19]

Plohberger et al.

[11] Patent Number: 5,033,419

[45] Date of Patent: Jul. 23, 1991

[54] SCAVENGE CONTROL SYSTEM

[75] Inventors: Diethard Plohberger; Christof D. Fischer; Volker Pichl, all of Graz, Austria

[73] Assignee: AVL Gesellschaft, Graz, Austria

[21] Appl. No.: 516,765

[22] Filed: Apr. 30, 1990

[30] Foreign Application Priority Data

May 2, 1989 [AT] Austria ..... 1048/89

[51] Int. Cl.[5] ..... F02B 33/44

[52] U.S. Cl. ..... 123/73 V; 123/73 PP

[58] Field of Search ..... 123/73 A, 73 B, 73·C, 123/73 V, 65 V, 73 PP; 251/129.01, 65, 129.22; 137/855, 856, 523

[56] References Cited

U.S. PATENT DOCUMENTS

| | | | |
|---|---|---|---|
| 3,269,689 | 8/1966 | Lee | 251/129.01 |
| 3,370,305 | 2/1968 | Goott et al. | 137/855 |
| 4,089,348 | 5/1978 | Yoshida et al. | 137/856 |
| 4,383,641 | 5/1983 | Shreve | 137/523 |
| 4,388,895 | 6/1983 | Boyesen | 123/73 A |
| 4,585,209 | 4/1986 | Aine et al. | 137/855 |
| 4,690,372 | 9/1987 | Thiebaud | 251/65 |
| 4,748,944 | 6/1988 | Iida et al. | 123/73 V |
| 4,879,976 | 11/1989 | Boyesen | 123/73 V |

FOREIGN PATENT DOCUMENTS 380538 6/1986 Austria .

*Primary Examiner*—Willis R. Wolfe
*Assistant Examiner*—Thomas N. Moulis
*Attorney, Agent, or Firm*—Watson, Cole, Grindle & Watson

[57] ABSTRACT

To improve control of the scavenging in accordance with the load and speed conditions in a two-stroke internal combustion engine with scavenge passages which open into the interior of the cylinder and an outlet passage and with scavenge ports and an outlet port governed by the piston of said internal-combustion engine, the present invention provides that communication with said scavenge passages is governed by an electromagnetically unlocking pressure-controlled valve, which is positioned in a passageway section and actuation of which within the opening periods of the scavenge ports, blocks the flow of the scavenging agent to the individual scavenge ports to the effect that the period of scavenging is timed relative to the load and speed conditions under which the internal-combustion engine is working.

10 Claims, 3 Drawing Sheets

SCAVENGE CONTROL SYSTEM

BACKGROUND OF THE INVENTION

The present invention relates to a scavenge control system for a two-stroke internal-combustion engine with scavenge passages which open into the interior of the cylinder and an outlet passage, and with scavenge ports and an outlet port governed by the piston of the internal-combustion engine.

DESCRIPTION OF THE PRIOR ART

The known types of scavenge control systems in two-stroke internal-combustion engines have certain disadvantages when the engine is operating under partial-load conditions, since in the interior of the cylinder the admitted volume of fuel-air mixture (and of fresh air, respectively, if the mixing is performed inside the cylinder) blends with the residue gas contained therein, and since the mass of charge is not within optimum distance to the spark plug at the moment of ignition. As a result, the undesirable effect of misfirings occurs when the engine is operating.

One of the methods to avoid the effect of misfirings in two-stroke internal-combustion engines with inside mixing of the charge was, for instance, to increase the volume of scavenging air admitted during partial-load conditions. This method proves disadvantageous in that it causes the temperature of the burned gas to sink again and thereby impairs the quality of catalytic processing of the gases.

Generally, it would also be possible to time the scavenging procedure by varying the vertical dimensions of the openings along which the piston passes and through which the agent is sucked in. Openings of variable height have been described in connection with controllable outlet means like those disclosed, for instance, in EP-A 0 287 938 or in Austrian Patent Nr. 380 538. The latter describes a flap means which is positioned in the outlet passage of a two-stroke internal-combustion engine, with one side mounted on bearings, and by mechanical actuation of which the height of the outlet port is diminished accordingly.

However, using this type of a control means in the scavenging procedure would require simultaneous actuation of all scavenge openings and thus result in further expenses on the construction side. In addition, leakages occur along that part of the flap which meets the piston so that this method of control is hardly suited for the governing of scavenge systems.

SUMMARY OF THE INVENTION

It is an object of the present invention to improve known control systems for the scavenging of two-stroke internal-combustion engines in such way as to exclude, at justifiable expenses on the construction side, misfirings during the operation of the internal-combustion engine even under partial load conditions without impeding, at the same time, the catalytic processing of the exhaust gases.

The present invention achieves this object by governing communication with the individual scavenge ducts by means of an electromagnetically unlocking, pressure-controlled reed valve which is positioned in a section of the passageway and actuation of which, during the opening periods of the scavenge ports, blocks the flow of the scavenging agent to the individual orifices to the effect that the scavenging period can be timed in accordance with load and speed conditions of the internal-combustion engine. A scavenge control system embodying the present invention permits simple timing of the scavenging procedure in two-stroke engines and is equally suited for engines with reverse scavenging and the one-way-scavenging type. The system aims at improving the operating conditions of the engine by regulating the volume of fuel-air mixture and fresh air, respectively, sucked into the cylinder during one cycle. The amount of required air can be either supplied by the crankcase pump formed by the piston of the engine, or delivered by an outside means, i.e., a blower. When compared to the known types of throttle means, the present scavenge control system offers the decisive advantage of governing the timing of the scavenge procedure. By retardation of the scavenge timing under partial-load conditions relative to the timing of scavenging under full-load conditions by actuating the magnetically unlocking reed valve, it is achieved that the mass of fuel-air mixture admitted to the combustion chamber is kept in concentrated form and that its mixing with the residue gas contained in the cylinder is largely prevented. In addition, adequate shaping of the combustion chamber and suitable arrangement of scavenge passages cause optimum positioning of the mass of fuel-air mixture next to the spark plug at the moment of ignition. The described method ensures that the engine operates free of misfirings even when the amount of residue gas is high due to partial-load conditions and, at the same time, prevents the temperature of the gas from dropping down again.

Although it would be absolutely possible to equip each of the scavenge passages with a separate magnetically unlocking reed valve, it is of advantage to follow the basic idea of the present invention by positioning the electromagnetically unlocking reed valve in a section of a joint passageway which connects to the individual scavenge ducts or, in case of a two-stroke internal-combustion engine of the crankcase-scavenging type, by arranging the electromagnetically controlled valve in a bypass passageway which connects the crankcase to the cylinder.

A preferred development of the present invention is characterized in that the electromagnetically unlocking reed valve has at least one, but preferably two diaphragm reeds of symmetrical shape, and with one side of each reed being mounted on bearings in the joint passageway section; when the valve locks, the freely moving, ferromagnetic end(s) of the reed(s) is/are held in place by one, or more, electromagnet(s) mounted on a support portion in the joint passageway section. Either the entire piece(s) or at least the free end(s) of the diaphragm reed(s) is/are ferromagnetic and, if locked, fixed in the correct position by (an) electromagnet(s) such that the flow of the scavenging agent through the respective orifices is blocked in spite of the pressure difference caused by the opening of the ports and still acting upon the diaphragm. In order to unlock the diaphragm valve the electromagnets are de-energized. Responding to the difference in pressures, the diaphragm opens and thereby permits the free flow of the scavenging agent toward the cylinder. The extent of flow resistance causes the reeds to remain open until the scavenge orifices are covered by the piston. As soon as the scavenging procedure is over, the opening force of the flowing agent fails to act upon the reeds and they begin to shut, partly responding to the natural resilient quality of the diaphragm and partly moved by the force of springs. Re-energizing of the electromagnets keeps the reeds of the diaphragm in their place during the cycle to come.

When the internal combustion engine is operating under full-load conditions, the scavenge control system can either remain de-energized, with the positions of the diaphragm reeds being solely determined by the extent of existing flow resistance, or be arranged according to a further development of the present invention wherein, under full-load operation of the two-stroke internal-combustion engine, the at least one diaphragm reed is fixed in the wall of the passageway section during the unlocking of the reed valve, by means of an electromagnet located there. This variant offers the advantage of reducing the total amount of flow resistance in the herein described arrangement of a diaphragm valve.

Another type of arrangement embodying the present invention is characterized in that the electromagnetically unlocking reed valve comprises two preferably frame-like support units of symmetrical form, each of which is rotatably mounted on bearings in the joint passageway section, whereas the other—freely moving—end of each support unit is equipped with an electromagnet; and two diaphragm reeds, one side of each of which is fixedly mounted on one support unit and which, during the locking of the reed valve, are held in place by the electromagnets; and with recesses in the wall of the passageway section, which provide room for both the support units and the reeds when the two-stroke internal-combustion engine is operating under full-load conditions; and a rod mechanism by means of which the two support units are moved and fixed in open position under full-load conditions. When the valve locks, the reeds can be fixed by energizing of the magnets, whereas the power is switched off under partial-load conditions to order to open the valve. Under full-load conditions the support units are folded away by means of said rod mechanism and so fixed in open position as to minimize the extent of flow resistance.

Finally, the present invention provides that the diaphragm reeds or the support units are located in a passageway section of rectangular shape of the cross-section and in a basically roof-like arrangement, with the freely moving ends of the reeds or of the support units pointing in the direction in which the scavenging agent flows.

DESCRIPTION OF THE DRAWINGS

The invention will now be illustrated by way of accompanying drawings in which, in a partly schematic layout.

DESCRIPTION OF THE PREFERRED EMBODIMENTS

Figure 1:
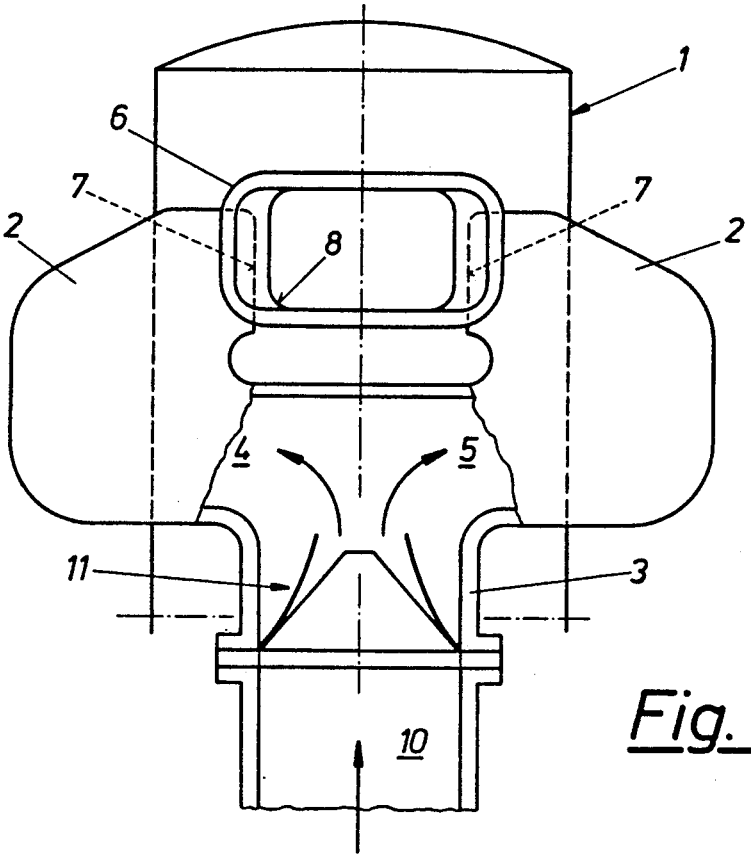
FIGS. 1 and 2 show a side elevation and a cross-sectional view, respectively, of a scavenge control system in a two-stroke internal-combustion engine embodying the present invention.
Figure 2:
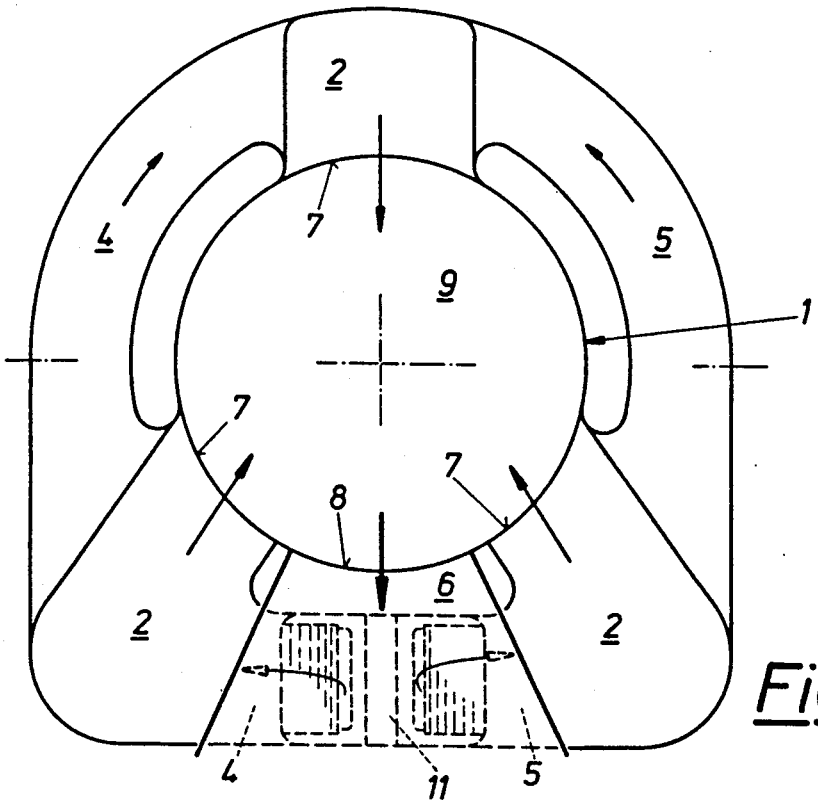

The scavenge control system of a two-stroke internal-combustion engine shown in FIGS. 1 and 2 comprises three scavenge passages 2 which open into the interior of a cylinder 1 and which are furnished with the charge or, if the mixing is performed inside the cylinder, with fresh air from a joint passageway section 3 via passageway portions 4 and 5. Two of the scavenge passages 2 are positioned at both sides of an outlet passage 6, one scavenge passage is opposite the outlet passage 6. Scavenge ports 7 and an outlet port 8 are governed by a piston 9 of the internal-combustion engine. During the scavenging procedure the medium is either sucked in by a crankcase pump formed by the engine piston but not shown herein or provided by an outside means, i.e., a blower, which releases fresh air into a pipe socket 10.

The rigid control means formed by the scavenge ports or orifices 7 is governed by an electromagnetically unlocking, pressure-controlled reed valve 11 which is located in the passageway section 3 and which, within the respective opening period determined by the actuation of the scavenge ports 7, releases, or alternatively blocks, the flow of the medium. To suit the purpose of this invention, the timing of the scavenging is interfered with in such way as to make the electromagnetically unlocking reed valve remain locked until after the scavenge ports 7 have opened, with this period of retardation being rated in accordance with the load decrease, and, having thus determined the actual beginning of the scavenging procedure, to make them remain open until after the scavenging ports 7 have been covered. Thus, the end of the scavenging procedure is determined by the timing of the de-actuation of the openings 7. Since the re-locking of reed valve 11 is allowed to take the whole time during which the scavenge ports 7 are covered by the piston 9, the closing speed can be relatively low and therefore permits a low-cost construction of the necessary operating means.

Figure 3:
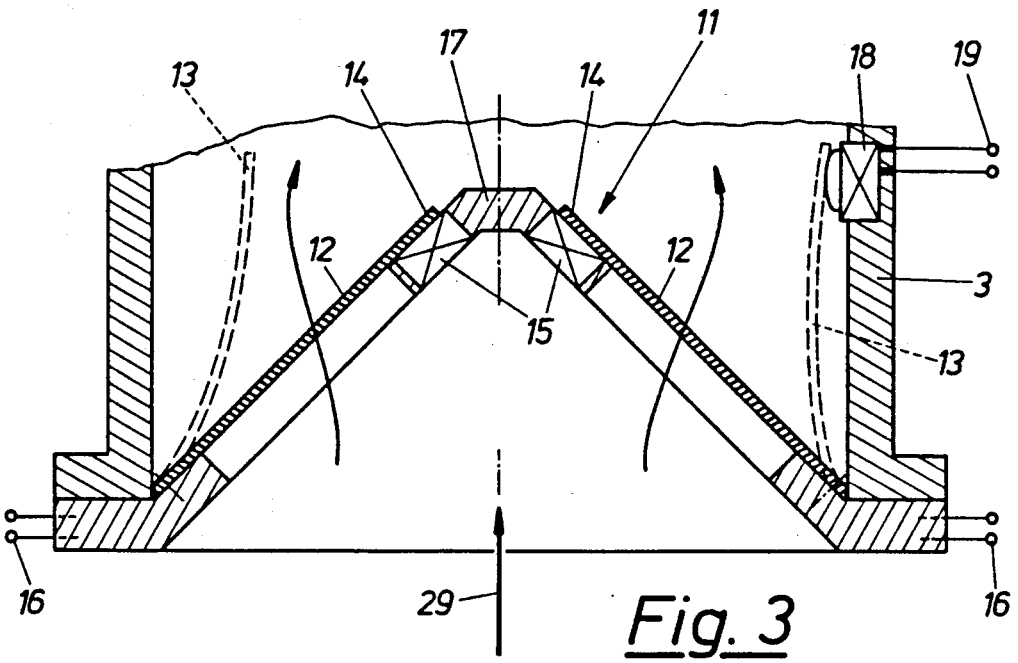
FIG. 3 shows an electromagnetically unlocking reed valve of the scavenge control system.

As shown in FIG. 3, the electromagnetically unlocking reed valve comprises two diaphragm reeds 12, one side of each of which is fixedly mounted in the passageway section 3 whereas their freely moving, ferromagnetic ends 14 are held in place by electromagnets 15 as long as the valve locks. The electromagnets 15, with respective current leads 16, are mounted on a support portion 17 positioned in the passageway section 3.

Also, the invention offers the possibility that the entire bodies of the diaphragm reeds 12 are ferromagnetic and that they lock automatically after termination of the scavenging, due to their natural resilient qualities or their being forced back by springs, not shown herein.

When the internal-combustion engine is operating under full-load conditions, the reeds 12 are held in unlocking position 13 by means of electromagnets 18, which are mounted in the wall of the passageway section 3 and energized via current leads 19. When the reeds have opened to maximum width, the magnets fix them in this position so that the overall force of flow resistance in the reed valve 11 is reduced.

Figure 4:
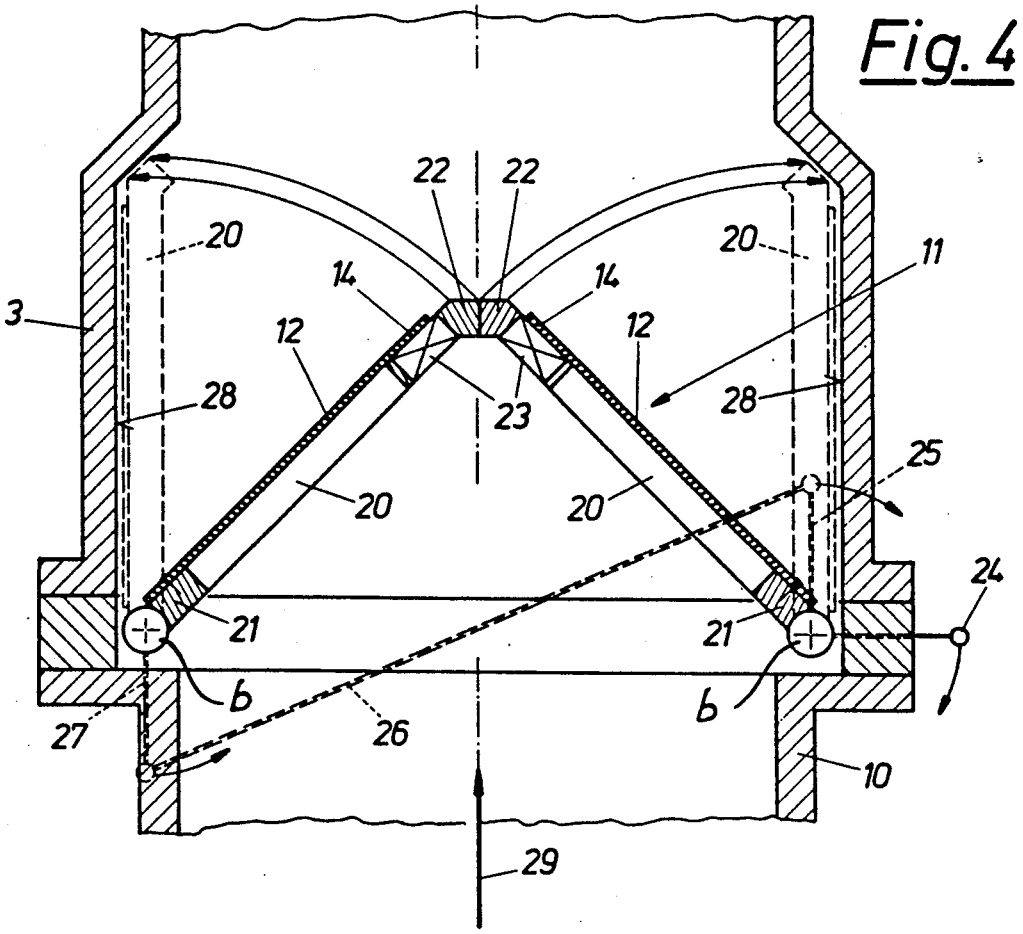
FIG. 4 shows another embodiment of the invention based on FIG. 3.

FIG. 4 shows another embodiment of the present invention, in which the electromagnetically unlocking reed valve 11 comprises two support units 20 of basically symmetrical form, with one end 21 of each unit being rotatably mounted on bearings b in the passageway section 3, whereas the other, freely moving, ends 22 in the herein shown locking position of the diaphragm valve meet sealingly. Each of the support units 20, which here are shown as being of frame-like shape, has a reed 12 attached to its end 21, while the free ends 14 of the reeds 12 respond to the electromagnets 23 fixedly mounted at the free ends 22 of the support units 20.

Under partial-load conditions the diaphragm reeds 12 are released by the electromagnets 23 in the way represented in the description of FIG. 3, whereas the support units 20 are held in place by rod mechanism 24 through 27. Under full-load conditions the body of the valve, consisting of support units 20 and reeds 12, divides into symmetrical parts, each of which folds up with the help of the mechanism 24 through 27 into recesses 28 in the sides of passageway section 3, where they are fixed. With the valve folded away, the passing scavenging agent is permitted to fill the entire duct. Roof-like positioning of the reeds 12 and the support units 20, respectively, facilitates their being pushed open by the agent flowing along arrow 29.

Figure 5:
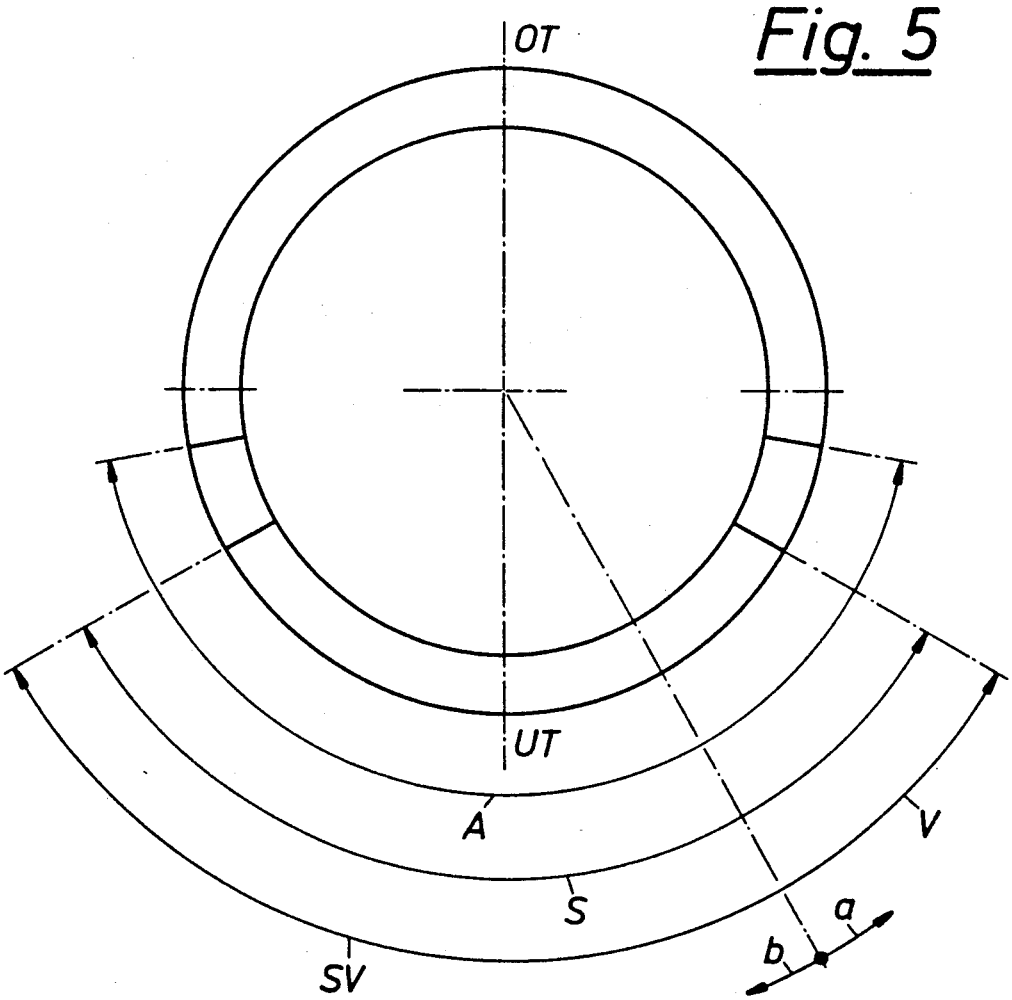
FIG. 5 is a timing diagram of the scavenging of a two-stroke internal-combustion engine.

FIG. 5 illustrates the scavenge control system of a two-stroke internal-combustion engine embodying the present invention by way of a schematic angular diagram. Maximum opening time A of the outlet port and maximum opening time S of the scavenge passages is determined by the vertical dimensions of the outlet and scavenge ports in the cylinder of the internal-combustion engine. As the piston passes by the ports, the passages are cleared in correspondence with specific angular sections A and S, respectively, and in symmetric relation to the bottom dead centre position UT. By using a scavenge control system embodying the present invention the beginning of scavenging is retarded relative to the load and speed conditions by the time V, such retardation causing blocking of the flow of the scavenging agent within the angular section V and permitting scavenging in section SV only. The timing of the unlocking of the reed valve shifts in direction a in case of load increases and in direction b under reduced load conditions.

We claim:

1. A scavenge control system for a two-stroke internal-combustion engine with at least one cylinder and a reciprocating piston, comprising scavenge passages opening into said cylinder and an outlet passage, said passages having scavenge ports and an outlet port which are governed by said piston, wherein an electromagnetically unlocking, pressure-controlled reed valve is positioned in a passageway section, controlling communication with said scavenge passages, by actuation of said reed valve during the opening periods of said scavenge ports, the flow of a scavenging agent to the individual scavenge ports is blocked, to the effect that the time period of scavenging is controllable relative to the load and speed conditions of said internal-combustion engine, and wherein said reed valve comprises at least one diaphragm reed, with one side of each reed being fastened on a support portion in said passageway section and with free, ferromagnetic ends which, when said reed valve is in locking position, are held in place by electromagnets mounted on said support portion in said passageway section.

2. A scavenge control system according to claim 1, wherein electromagnets are positioned in said passageway section and said at least one diaphragm reed is held in place by said electromagnets, for the period during which said reed valve is in an unlocking position.

3. A scavenge control system according to claim 1, wherein said reed valve comprises two symmetrically shaped diaphragm reeds.

4. A scavenge control system according to claim 1, wherein said diaphragm reeds of said reed valve are positioned in said passageway section having a rectangular shape of cross-section, said diaphragm reeds building a substantially roof-type construction, with the freely moving ends of said reeds pointing in a direction in which the scavenging agent flows.

5. A scavenge control system according to claim 1, wherein said electromagnetically unlocking reed valve is positioned in a joint passageway section which connects to said individual scavenge passages.

6. A scavenge control system according to claim 1, for a two-stroke internal-combustion engine with crankcase scavenging, wherein said electromagnetically unlocking reed valve is positioned in a bypass passageway connecting said crankcase to said cylinder.

7. A scavenge control system for a two-stroke internal-combustion engine with at least one cylinder and a reciprocating piston, comprising scavenge passages opening into said cylinder and an outlet passage, said passages having scavenge ports and an outlet port which are governed by said piston, wherein an electromagnetically unlocking, pressure-controlled reed valve is positioned in a passageway section, controlling communication with said scavenge passages, by actuation of said reed valve during the opening periods of said scavenge ports, a flow of the scavenging agent to the individual scavenge ports is blocked, to the effect that the time period of scavenging is controllable relative to the load and speed conditions of said internal-combustion engine, and wherein said reed valve comprises two frame-like support units of symmetrical form, each of said support units is rotatably mounted on bearings in said passageway section and carries, on the respective free end, an electromagnet, by the force of which a diaphragm reed, with one side being fixedly mounted to said respective support unit, is held in place as long as said reed valve remains locked, and wherein said passageway section has recesses, where said two support units and said reeds find room during operation of said two-stroke internal-combustion engine under full-load conditions, and wherein said support units are moved by means of a rod mechanism and fixed in unlocking position under full-load conditions.

8. A scavenge control system according to claim 7, wherein said support units are positioned in said passageway section, having a rectangular shape of cross-section, said support units building a substantially roof-type construction, with the freely moving ends of said support units pointing in direction in which the scavenging agent flows.

9. A scavenge control system according to claim 7, wherein said electromagnetically unlocking reed valve is positioned in a joint passageway section which connects to said individual scavenge passages.

10. A scavenge control system according to claim 7, for a two-stroke internal-combustion engine with crankcase scavenging, wherein said electromagnetically unlocking reed valve is positioned in a bypass passageway connecting said crankcase to said cylinder.

* * * * *

UNITED STATES PATENT AND TRADEMARK OFFICE

CERTIFICATE OF CORRECTION

PATENT NO. : 5,033,419

DATED : July 23, 1991

INVENTOR(S) : PLOHBERGER, Diethard et al.

It is certified that error appears in the above-identified patent and that said Letters Patent is hereby corrected as shown below:

ON THE TITLE PAGE:

(73) Assignee: AVL Gessellschaft Fur Verbrennungskraftmaschinen Und Messtechnik M.B.H., Prof. Dr.Dr.h.c. Hans List, Graz, Austria

Signed and Sealed this

Twelfth Day of January, 1993

*Attest:*

DOUGLAS B. COMER

*Attesting Officer*

*Acting Commissioner of Patents and Trademarks*